United States Patent [19]

Wheelock

[11] Patent Number: 4,953,748

[45] Date of Patent: Sep. 4, 1990

[54] FORCE MODIFYING DEVICE

[75] Inventor: Norman R. Wheelock, Mentor, Ohio

[73] Assignee: Diebold, Incorporated, North Canton, Ohio

[21] Appl. No.: 480,370

[22] Filed: Feb. 14, 1990

Related U.S. Application Data

[63] Continuation of Ser. No. 236,066, Aug. 23, 1988, abandoned.

[51] Int. Cl.[5] ..... B65H 1/12

[52] U.S. Cl. ..... 221/59; 221/198; 312/61; 271/160

[58] Field of Search ..... 221/52, 59, 198, 227, 221/231, 279, 280; 312/61, 71; 211/51, 59.3; 248/572; 267/172; 254/374; 271/160

[56] References Cited

U.S. PATENT DOCUMENTS

| | | | |
|---|---|---|---|
| 1,617,757 | 2/1927 | Gross . | |
| 2,251,875 | 8/1941 | Gibbs . | |
| 2,647,029 | 7/1953 | Deland . | |
| 3,216,410 | 11/1965 | Trombatore et al. . | |
| 3,655,186 | 4/1972 | Bayha . | |
| 3,871,725 | 3/1975 | Vilen et al. | 312/71 |
| 4,299,335 | 11/1981 | Ostermann . | |
| 4,524,965 | 6/1985 | Kulpa | 271/160 X |
| 4,685,648 | 8/1987 | Dobner et al. | 248/572 |

*Primary Examiner*—F. J. Bartuska

*Attorney, Agent, or Firm*—D. Peter Hochberg; Mark Kusner; Louis J. Weisz

[57] ABSTRACT

The present invention provides a system for transmitting a biasing force created by a force generating component to a load remote from the force component. the system includes a first elongated flexible element having a first end and a second end, the first end of the first flexible element being connectable to the force generating component, and a second elongated flexible element having a first end and a second end, the first end of the second flexible element being connectable to the load. A force modifying member rotatable about a fixed axis is provided and includes first and second outwardly facing surfaces of predetermined lengths which curve about the axis. The second ends of the elongated flexible elements are connected respectively to the first and second surfaces at one end of the surface, wherein the fexible elements are operable to be wound or unwound on the respective surfaces as the member rotates about the axis. The first flexible element produces a force moment about the axis in a first direction biasing the force modifying member into rotation in the first direction. The second element exerts a resultant biasing force on the load. The first and second surfaces are dimensioned such that rotation of the member about the axis in the first direction causes one of the elements to be wound onto its respective surface as the other element is unwound from the its respective surface top vary the force moments about the axis, to render the biasing force on the load generally more uniform.

4 Claims, 7 Drawing Sheets

FORCE MODIFYING DEVICE

This is a continuation of co-pending application Ser. No. 236,066 filed on Aug. 23, 1988, now abandoned.

FIELD OF THE INVENTION

The present invention relates generally to spring driven systems for article dispensing devices, and more particularly to a force modifying arrangement to produce a more uniform output force in a spring actuated biasing system. The arrangement is particularly applicable for use in a dispenser for dispensing very thin planar articles, such as currency notes, sheet paper, or the like, and will be described with particular reference thereto, although it will be appreciated that the invention has other broader applications where planar articles are driven by a push plate towards a dispensing position.

BACKGROUND OF THE INVENTION

The present invention finds advantageous application in a currency dispenser as used in automatic teller machines (ATMS). In such machines, a stack of bills of a particular denomination is generally disposed within an elongated canister having a dispensing position at one end thereof. From this dispensing position, the bills are dispensed individually by a transfer mechanism. The stack of bills is urged towards the dispensing position by means of a push plate. Generally, the push plate is biased (pulled) toward the dispensing position by means of a tension spring system. With such a system, the removal of currency and the resultant contraction of the tension spring inevitably leads to a reduction of the biasing force exerted on the push plate. In other words, the force on the push plate at the position where the canister is fully loaded continuously decreases as the push plate moves toward the dispensing position. In this respect, it is not unusual for the biasing force in such devices to decrease 67% or more as the push plate travels from a fully loaded position to an empty position. This change in the biasing force places severe requirements on the transfer mechanism which picks or removes the bills from the dispensing position, and generally leads to degraded performance of the transfer mechanism when the canister is fully loaded or near empty. The present invention overcomes this and other problems and provides a simple, reliable device for use with a spring force system, which device modifies the force generated by such system to produce a more uniform output biasing force.

SUMMARY OF THE INVENTION

In accordance with the present invention there is provided a system for transmitting a biasing force from a force generating component to a load remote from the force component. The system includes a first elongated flexible element having a first end and a second end, the first end of the first flexible element being connectable to the force generating component, and a second elongated flexible element having a first end and a second end, the first end of the second flexible element being connectable to the load. A force modifying member rotatable about a fixed axis is provided and includes first and second outwardly facing surfaces of predetermined length which curve about the axis. The second ends of the elongated flexible elements are connected respectively to the first and second surfaces at one end of each surface. The flexible elements are operable to be wound or unwound on the respective surfaces as the member rotates about the axis. The first flexible element produces a force moment about the axis in a first direction biasing the force modifying member into rotation in the first direction. The second element exerts a resultant biasing force on the load. The first and second surfaces are dimensional such that rotation of the member about the axis in the first direction causes one of the elements to be wound onto its respective surface as the other element is unwound from its respective surface in a manner which varies the force moments about the axis.

In accordance with another aspect of the present invention, there is provided a device for moving a stack of generally planar articles toward a dispensing position where individual articles are to be dispensed, which device includes means for maintaining a generally uniform force on the stack in the direction of the dispensing position. The device includes plate means movable along a predetermined path between a first position remote from the dispensing opening and a second position adjacent the dispensing opening for pushing the stack toward the dispensing position; a plate cable means having a first end and second end, the first end being connected to the plate means; a tension spring having a stationary end fixed relative to the dispensing position and a free end movable along a predetermined spring path between a first position wherein the spring is extended a predetermined distance and a second contracted position, the spring defining a tension force having a predetermined value when in the first position, which tension force diminishes as the spring retracts along the spring path toward the second position; spring cable means having a first end and a second end, the first end being connected to the free end of the tension spring; and a force modifying member for transmitting the tension force in the spring to the plate means to move the plate means along the plate path. The modifying member is rotatable about an axis fixed relative to the dispensing opening, and includes first and second outwardly facing contoured surfaces to receive the tension spring cable means and the plate cable means, respectively. The second ends of the cable means are attached to the modifying member such that the spring cable means is disposed on the first surface when the spring is in the first position. The tension force of the spring biases the modifying member to rotate in a predetermined direction, which rotation produces a resultant biasing force on the plate means via the plate cable means to force the plate means toward the dispensing position. The first surface is dimensioned to vary the distance between the spring cable means and the axis as the modifying member rotates, wherein the resultant biasing force acting on the plate means is maintained generally more uniform as the plate means moves between the first position and the second position.

It is an object of the present invention to provide a device to modify the force generated by a spring system or the like into a more uniform force with a less radical drop-off as the spring contracts.

Another object of the present invention is to provide a dispensing canister for currency, documents or the like wherein the force exerted on the currency or documents to move the same toward a dispensing position remains more uniform between a full canister condition and an empty canister condition.

A still further object of the present invention is to provide a device for moving planar articles toward a dispensing location.

These and other objects and advantages of the invention will become apparent from the following description of an embodiment thereof taken together with the accompanying drawings.

BRIEF DESCRIPTION OF THE DRAWINGS

The invention may take physical form in certain parts and arrangement of parts, a preferred embodiment of which will be described in detail in the specification and illustrated in the accompanying drawings wherein.

DETAILED DESCRIPTION OF A PREFERRED EMBODIMENT

Figure 1:
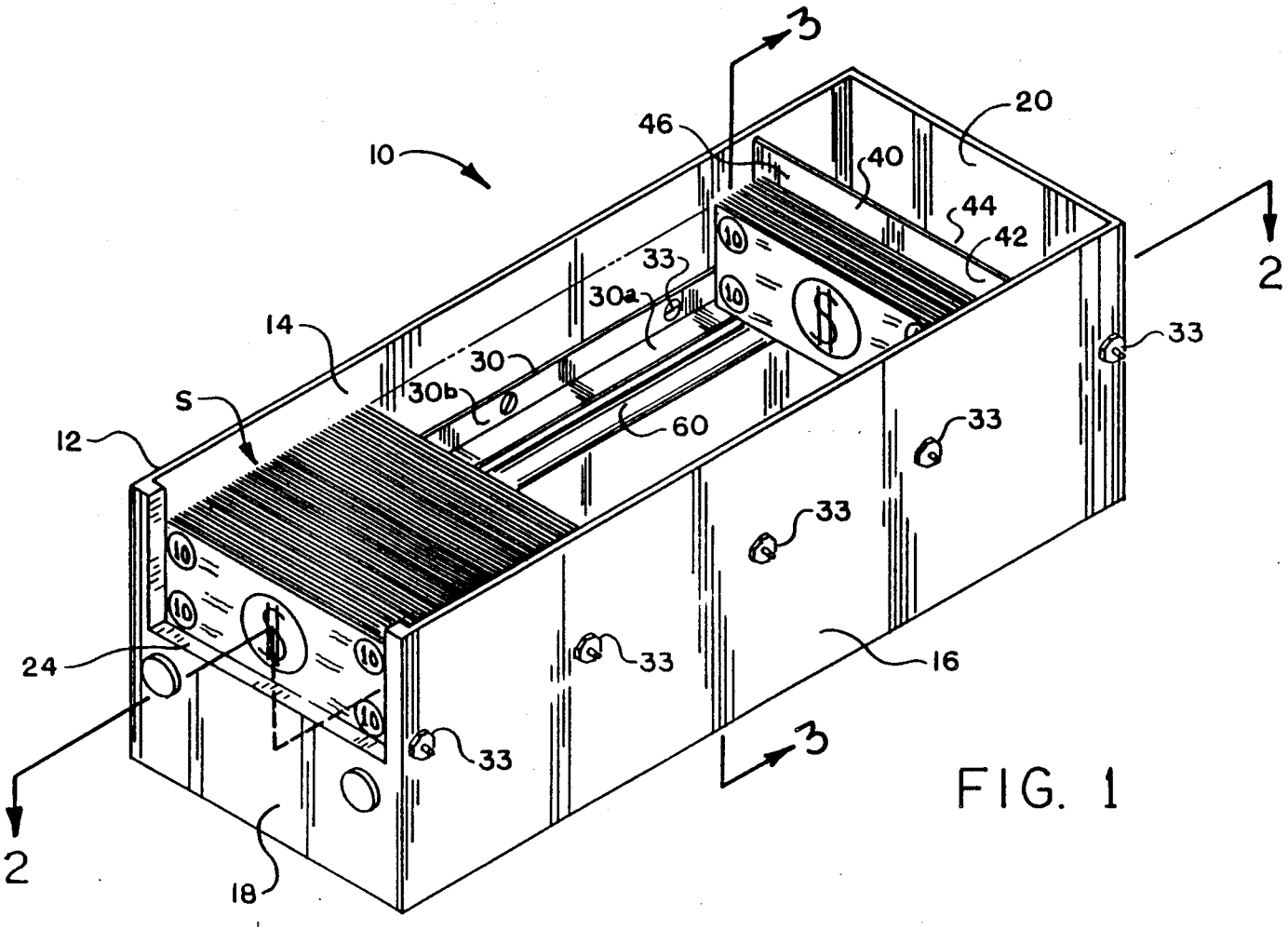
FIG. 1 is a perspective view of a currency dispensing canister illustrating a preferred embodiment of the present invention.

Referring now to the drawings wherein the showings are for the purpose of illustrating a preferred embodiment of the present invention and not for the purpose of limiting same, FIG. 1 shows a currency dispensing canister 10 for use in an automatic teller machine (ATM). Canister 10 is comprised of a generally rectangular housing 12 having side walls 14, 16, end walls 18, 20 and bottom wall 22. End wall 18 includes a generally rectangular opening 24 in the upper portion thereof, which opening 24 defines a dispensing opening from which individual bills are to be removed by a transfer mechanism (not shown). A pair of generally L-shaped tracks 30, 32 extend along the length of side walls 14, 16 and are secured thereto by fasteners 33. Tracks 30, 32 include horizontal leg portions **30*a*, 32*a* and vertical leg portions 30*b*, 32*b*. Tracks 30 and 32 are positioned such that horizontal leg portions 30*a*, 32 *a* are generally coplanar and define a surface 34, best seen in FIG. 3. Tracks 30, 32 generally divide the canister into an upper compartment 36 and a lower compartment 38. Upper compartment 36 is dimensioned to hold a stack of planar, sheet like material such as currency, which stack is designated "S" in the drawings. In this respect, stack S rests on surface 34 as shown in the drawings, and a push plate 40 is provided to move stack S along surface 34 toward opening 24**.

Figure 2:
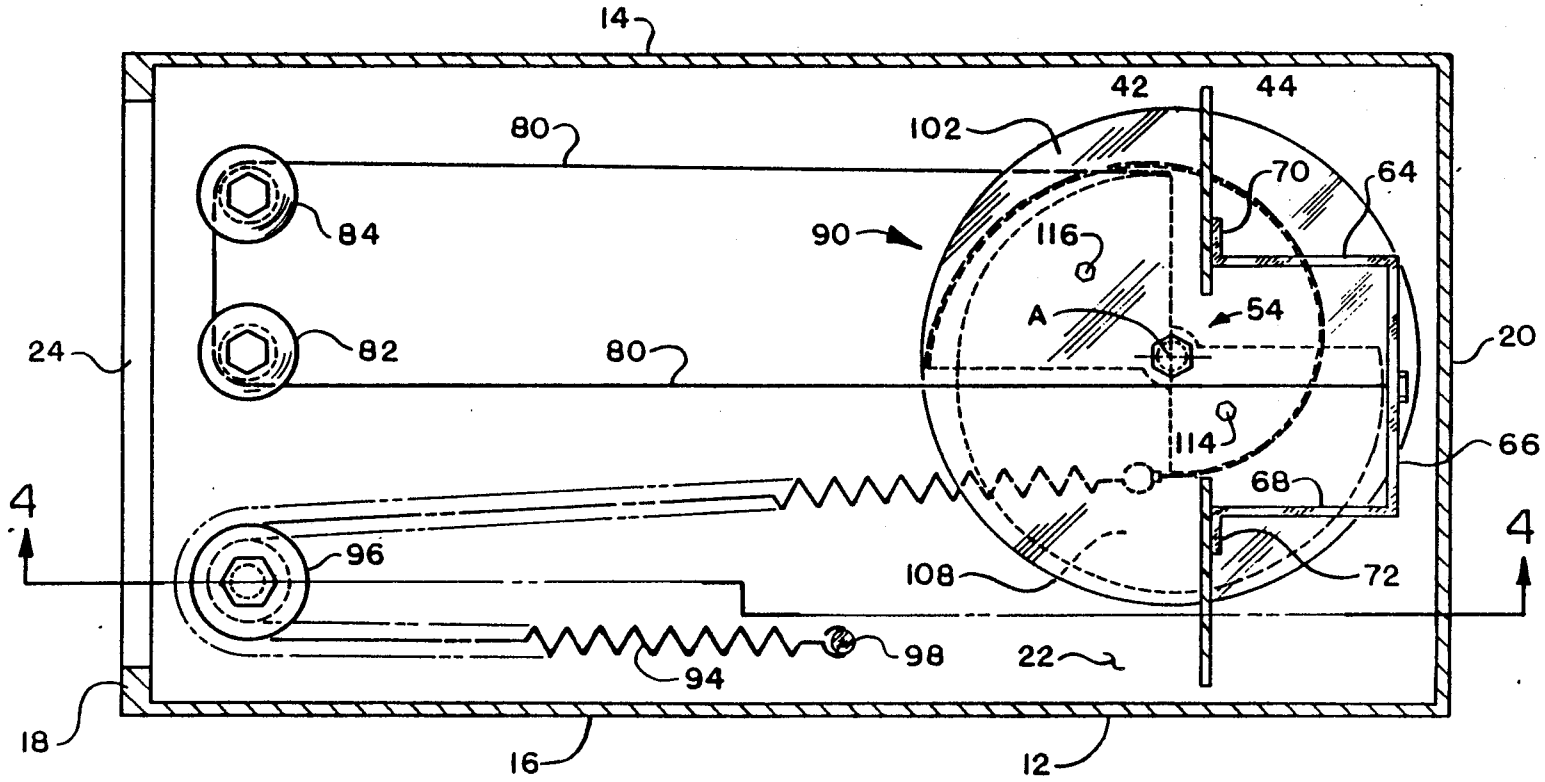
FIG. 2 is an enlarged sectional view taken along 2—2 of FIG. 1 illustrating the position of various components of the currency dispensing canister when the canister is in a fully loaded condition.
Figure 3:
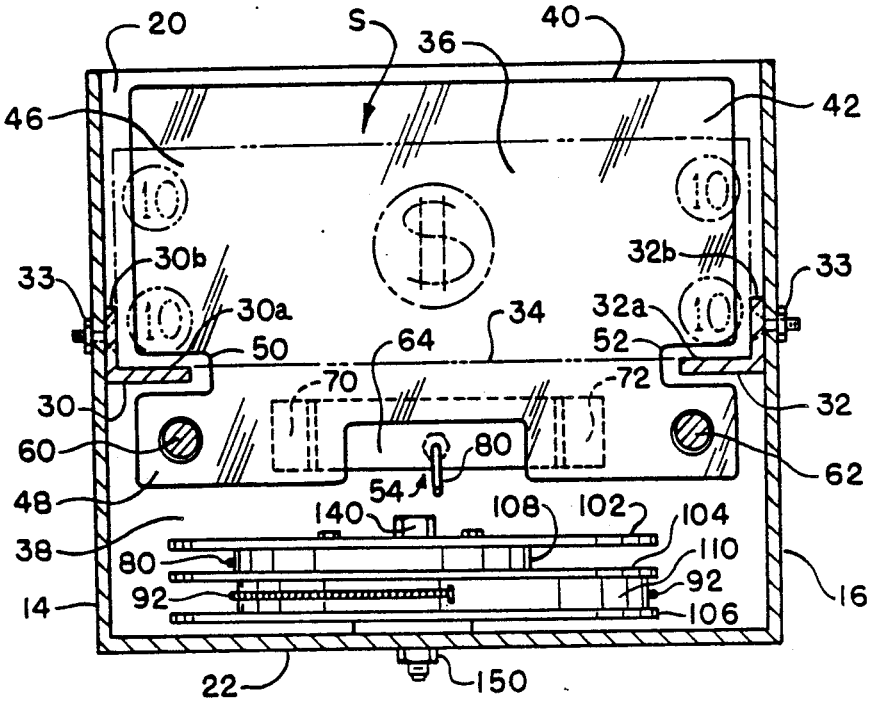
FIG. 3 is an enlarged sectional view taken along line 3—3 of FIG. 1.

Push plate 40 includes a front side 42 adapted to engage stack S and a back side 44. As best seen in FIG. 3, push plate 40 includes an upper portion 46 adapted to move within upper compartment 36 and a lower portion 48 dimensioned to travel in lower compartment 38. In this respect, notches 50, 52 are provided in the sides of push plate 40 to accommodate horizontal legs **30*a*, 32*a* of tracks 30, 32, respectively. A rectangular notch 54 is also provided at the bottom of lower portion 48, as seen in FIG. 3. Push plate 40 is mounted for horizontal travel along parallel cylindrical guides 60, 62 which extend between end walls 18 and 20. Guides 60, 62 are secured to end walls 18, 20 in a known manner. Secured to back side 44 of lower portion 48 of push plate 40 is a generally U-shaped bracket 64, best seen in FIGS. 2, 4 and 8. Bracket 64 has a closed end 66 an opened end 68, with mounting feet 70, 72 adjacent opened end 68. Bracket 64 is mounted to push plate 40 such that mounting feet 70, 72 are on opposite sides of rectangular notch 54, as shown in FIG. 3. Bracket 64 may be secured to push plate 40** by soldering, welding or by conventionally-known fastener means.

Figure 4:
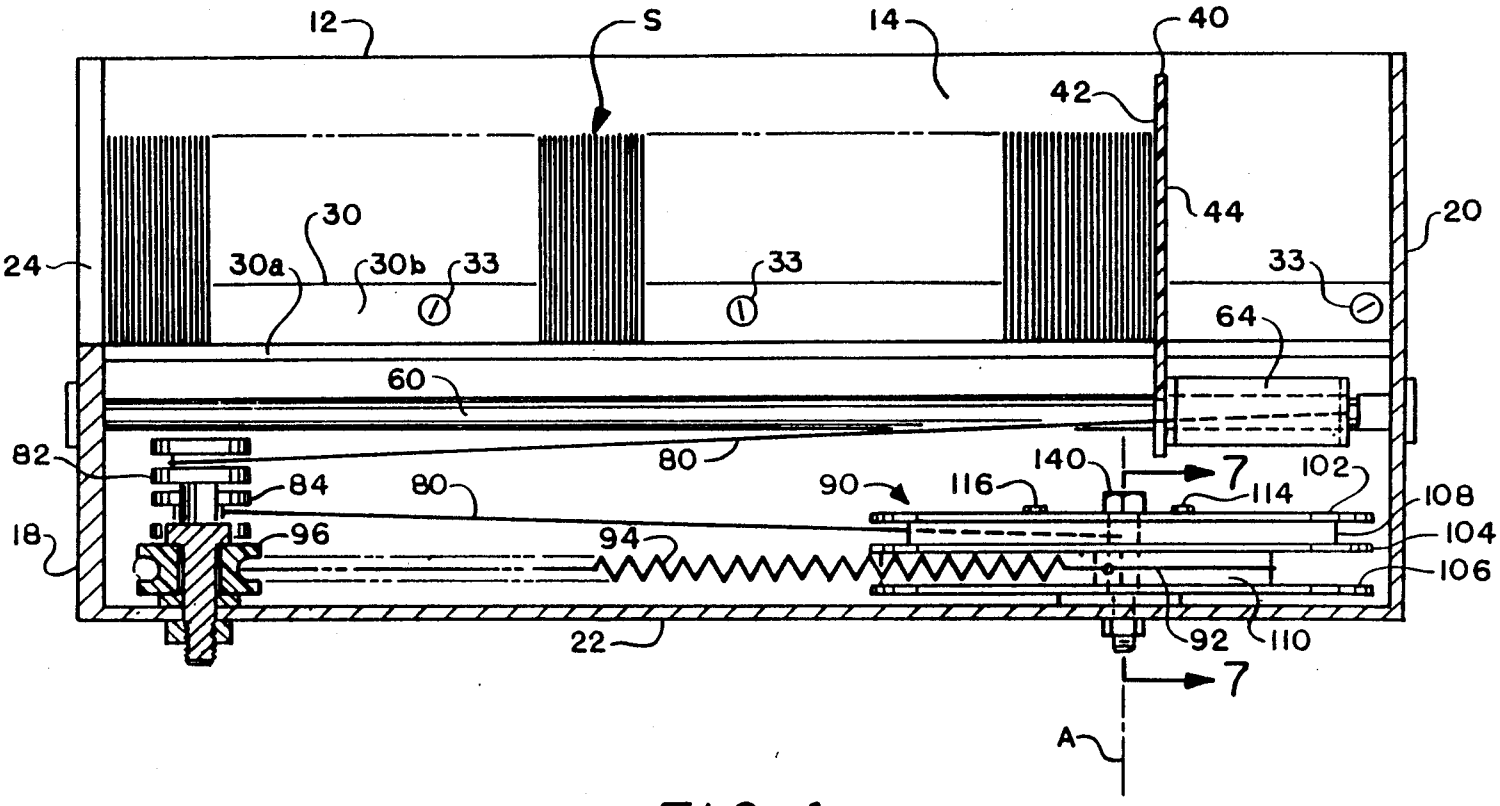
FIG. 4 is a sectional view taken along line 4—4 of FIG. 2.
Figure 7:
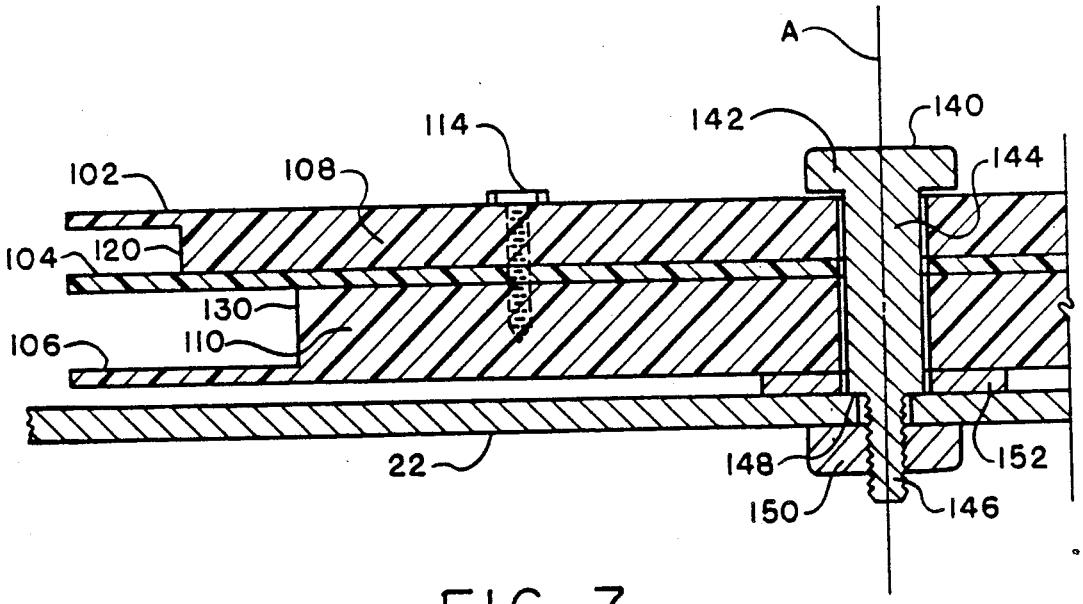
FIG. 7 is an enlarged sectional view taken along line 7—7 of FIG. 4.

A flexible element 80 is provided and secured at one end to closed end 66 of bracket 64. Flexible element 80 may be comprised of a cord, rope, cable or timing chain. In the preferred embodiment, flexible element 80 is comprised of a flexible wire cable. Flexible element 80 extends around a pair of pulleys 82, 84 as shown in FIGS. 2, 4 and 7. Pulleys 82, 84 are slightly elongated in shape to allow vertical travel of flexible element 80 along the bearing surface thereof. Pulleys 82, 84 are fixedly secured to bottom wall 22 of housing 12 by threaded fasteners in a conventional manner. The other end of flexible element 80 is secured to a force modifying unit 90 which is rotatable about a fixed axis designated "A" in the drawings (see FIGS. 2 and 4). Element 90 is fixedly mounted to housing 12 as will be described in greater detail below. Flexible element 80 operatively engages force modifying unit 90 to one side of axis A.

Another elongated flexible element 92 is connected to force modifying element 90. As with flexible element 80, flexible element 92 may be comprised of a cord, rope, cable or timing chain. In the preferred embodiment, flexible element 92 is also formed of a flexible wire cable. The other end of flexible element 92 is connected to an elongated tension spring 94. Tension spring 94 extends around a pulley 96 which is secured by conventional means in a fixed position to bottom wall 22. The other end of tension spring 94 is attached to a vertical post 98 which is fixedly secured to bottom wall 22. Spring 94 has a predetermined configuration, which will be discussed in greater detail below, and is dimensioned to maintain at all times tension on flexible element 92.

Figure 5:
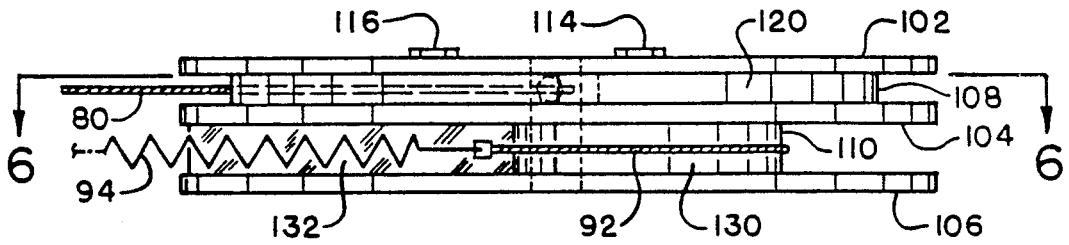
FIG. 5 is an enlarged side elevational view illustrating a force modifying element incorporating another concept of the present invention.
Figure 6:
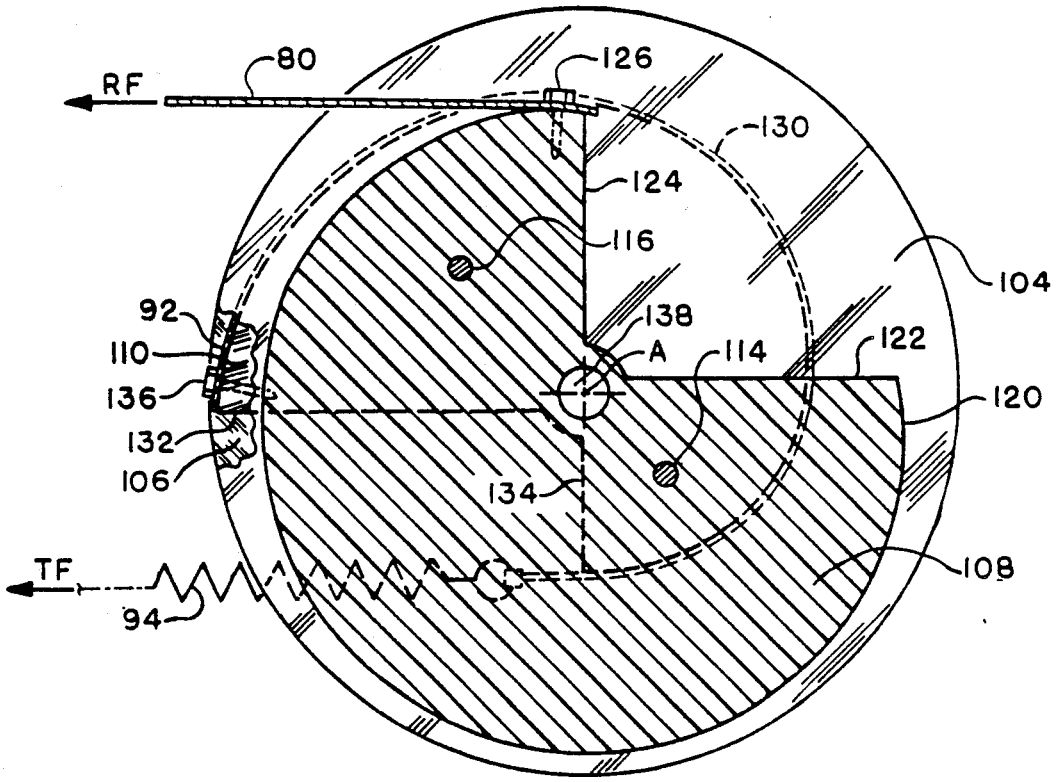
FIG. 6 is a sectional view taken along line 6—6 of FIG. 5.

Referring now to FIGS. 5, 6 and 7, force modifying unit 90 is shown. Unit 90 is generally comprised of three disk-shaped elements 102, 104, 106, best seen in FIG. 7. Disk-shaped elements 102 and 106 also include, respectively, cam portions 108, 110, which are molded, machined or otherwise formed thereon. Disk-shaped elements 102, 104, 106 are secured together by threaded fasteners 114, 116 (best seen in FIGS. 6 and 7) to form an integral unit. Cam portion 108 includes an outward facing arcuate cam surface 120 and two generally planar surfaces 122, 124, best seen in FIG. 6. In similar respects, cam element 110 includes an outward facing arcuate cam surface 130 and two generally planar surfaces 132, 134, best seen in FIG. 6. Cam surfaces 120, 130 are of a predetermined length and shape, and have a predetermined angular orientation with respect to each other.

Cam surface 120 is adapted to receive flexible element 80 thereon with one end of element 80 being secured thereto by fastener 126 as shown in FIG. 6. In similar respects, cam surface 130 is adapted to receive flexible element 92 thereon, with one end of element 92 being secured to surface 130 by means of a fastener 136. In this respect, flexible elements 80, 92 are adapted to be wound or unwound on cam surfaces 120, 130 respectively as force modifying unit 90 rotates about axis A. In this respect, each of the disk-shaped elements 102, 104, 106 includes an aperture therethrough, which aperture is in registry with apertures of the other elements to define a cylindrical opening or bore 138 through unit 90. Bore 138 is dimensioned to receive a pin 140 therein. Pin 140 includes a head portion 142, a shank portion 144 and a threaded fastener portion 146. Threaded fastener portion 146 has a smaller diameter than shank portion 144 and defines a shoulder 148 at the juncture therewith. A conventional nut fastener 150 secures pin 140 to bottom wall 22 of housing 12 as best seen in FIG. 7, wherein shoulder 148 is maintained against wall 22 by fastener nut 150. Force modifying unit 90 is adapted for pivotal movement about pin 140, the axis of pin 140 being axis A as defined above. A bearing member 152 is provided to elevate unit 90 above bottom wall 22 and to permit free rotation of unit 90 about pin 140.

The operation of force modifying unit 90 can best be described with reference to FIG. 6. Force modifying unit 90 basically operates by varying the force moment arms acting thereon about axis A. The tension force created by tension spring 94 acts through one of the moment arms, acting on unit 90, and the output or resultant force generated in flexible element 80 is determined by the other moment arm acting on unit 90. More specifically, as seen in the drawings, flexible element 92 wraps around cam surface 130 and is attached to tension spring 94 which exerts a force thereon. The tension force is exerted along the axis of tension spring 94, and in FIG. 6, an arrow designated "TF" depicts the tension force and its direction relative to unit 90. Tension force TF produces a force moment about axis A which is a function of the tension on spring 94 and the perpendicular distance from flexible element 92 to axis A. This force moment biases unit 90 into clockwise rotation about axis A. This rotation of unit 90 produces a resultant force designated "RF" on flexible element 80, and rotation of unit 90 causes flexible element 80 to wrap around or be wound onto surface 120 of cam portion 108. Element 80 is attached to a load (in the present embodiment, the load being push plate 40) remote from unit 90. The resultant force RF exerted on push plate 40 is a function of the tension force TF exerted on unit 90 by spring 94 and the relative lengths of the two moment arms. In this respect, the resultant tension force RF can be determined by dividing the force moment generated by tension force TF, by the perpendicular distance between axis A and flexible element 80. In other words, resultant force RF = force moment generated by tension spring 94 divided by the distance between axis A and flexible element 80.

As best seen in FIG. 6, surface 130 of cam portion 110 is generally helical in shape and a spirals outwardly from surface 134 to surface 132. In this respect, as force unit 90 rotates, the moment arm between tension force TF and axis A gradually increases. Simultaneously, tension spring 94 contracts. Thus, as tension spring 94 contracts and the tension force TF diminishes, the moment arm between such tension force and axis A increases thereby maintaining a more uniform force moment about axis A generally. With respect to cam portion 108, as can be seen from FIG. 6 cam surface 120 spirals outwardly slightly about axis A for an angular sweep of about 180° after which cam surface 120 decreases slightly as it approaches surface 122. In this respect, cam surface 120 also varies the moment arm between flexible element 80 and axis A and thereby modifies the resultant force acting on the remote load. Cam portions 108, 110 are oriented relative to each other such that rotation of force modifying unit 90 modifies tension force TF in a manner such that resultant force RF exhibits a substantially less radical force drop-off than that exhibited in tension spring 94 as the spring contracts.

Figure 8:
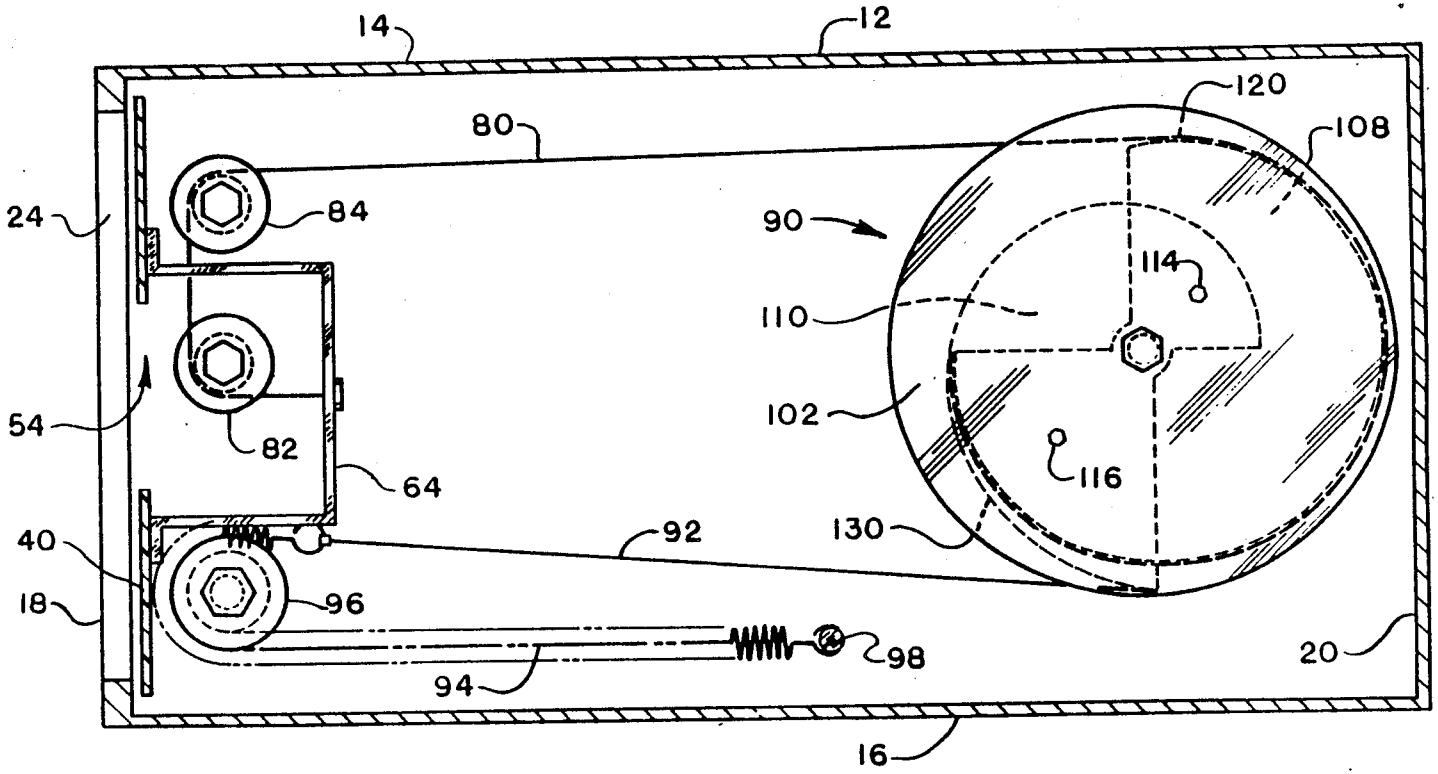
FIG. 8 is a sectional view, similar to that shown in FIG. 2, illustrating the position of the various components of the currency dispensing canister when the dispensing canister is in a nearly empty condition.

Force modifying unit 90 finds advantageous application in a money dispensing canister as described above. The operation of such a money canister can best be described with reference to FIGS. 2 and 8 wherein FIG. 2 shows the money dispensing canister 10 in a fully loaded condition. In this condition, push plate 40 is disposed away from dispensing opening 24 and tension spring 94 is fully extended with flexible element 92 wrapped around cam surface 130 of cam portion 110. Flexible element 80 connected to cam portion 108 exerts the resultant biasing force RF on push plate 40 to urge a stack of bills S (not shown) toward dispensing opening 24. As understood, tension spring 94 maintains the resultant biasing force RF on push plate 40. As individual bills are individually dispensed by a transfer mechanism (not shown), the tension on spring 94 causes force modifying unit 90 to rotate clockwise, which in turn wraps flexible element 80 onto cam portion 108 thereby pulling push plate 40 toward opening 24. As force modifying unit 90 rotates, the moment arm between the tension force TF exerted by spring 94 and axis A increases as a result of cam portion 110. Thus, although the tension force TF exerted by the spring is constantly decreasing, the moment arm between the tension force and axis A continually increases to generally maintain a more uniform resultant force on push plate 40. FIG. 8 shows the configuration of the dispensing canister when push plate 40 is near, or at, an empty position. As seen in this drawing, tension spring 94 has contracted a substantial length and rotated force modifying unit 90 approximately 270°. This rotation has caused flexible element 80 to be wrapped onto cam surface 110 of cam portion 108 and thereby pulled push plate 40 to dispensing opening 24. In this respect, the rectangular notch 54 on the lower portion of push plate 40 facilitates movement of push plate 40 over pulley 82.

As will be appreciated from the preceding discussion, the relation between tension force TF and resultant force RF is a function of the shapes of respective cam portions 108, 110 of modifying unit 90, and the spring constant of tension spring 94. In addition, with respect to the shape of unit 90, cam surfaces 120, 130 are related to the desired travel of push plate 40 between a fully loaded position and a fully empty position, as well as the length of tension spring 94.

Consider as an example with respect to the currency dispensing canister disclosed in the drawings, it was desired: to produce a money dispensing canister wherein the travel of the push plate 40 would be approximately 34 centimeters, to provide a minimum resultant force RF of approximately 600 grams on push plate 40 when the canister was nearly empty, and to maintain the resultant tension force within several hundred grams (approximately 300) throughout the travel push plate 40 from a fully loaded condition to a fully empty condition. With respect to such a device, a stack of currency approximately 34 centimeters long weighs approximately 2,900 grams. Therefore to compensate for an estimated 290 grams of frictional force resistance, the force on the push plate 40 when the canister is fully loaded is preferably approximately 890 grams. To provide the tension force, a tension spring 94 having a spring constant of approximately 34 grams (force/centimeter of spring extension was selected. As set forth above, the tension spring 94 is installed in such a manner that a tension is constantly maintained on flexible element 92 even when the push plate is in an empty condition as shown in FIG. 8. With respect to the embodiment shown, a spring with the aforementioned spring constant was installed such that the spring would be extended 14.7 centimeters and provide a 500 gram force when the canister and push plate were at an empty condition. An additional extension beyond this empty condition establishes the "working range" of tension spring 94. The working range of spring 94 is illustrated by the position of spring 94 in FIGS. 2 and 8. With respect to the embodiment shown, the working range of tension spring 94 is approximately 27 centimeters. Accordingly, force modifying unit 90 was dimensioned such that a contraction of 27 centimeters by tension spring 94 produces a travel of approximately 34 centimeters by push plate 40, and at the same time, exerted on push plate 40 a force varying between 890 grams at the fully loaded condition to approximately 600 grams at the fully empty position. With respect to the aforementioned tension spring 94, at its fully extended position, the force of spring 94 is approximately 1,400 grams and as set forth above, and at the end of its "working range" (i.e. at its contracted position) is approximately 500 grams. Cam portions 108, 110 have been dimensioned to modify the tension force exerted by spring 94 into a more uniform resultant force RF exerted on push plate 40. The following table provides specific information on force modifying unit 90 shown in the drawings.

| Ratio TF Arm to Driven Arm | "RF" Arm Length (cm) | Travel of Push Plate 40 (cm) | Total Device Rotation Radians/Degrees | | "TF" Arm Length (cm) | Spring Extension (working range) (cm) | "TF" at Given Extension (grams force) | "RF" Force (grams force) |
|---|---|---|---|---|---|---|---|---|
| Full Canister | | | | | | | | |
| .633 | 6.0 | | 0 | 0 | 3.80 | 26.65 | 1406.1 | 890 |
| | | 1.36 | | | | | | |
| .640 | 6.125 | | .224 | 12.8° | 3.92 | 25.78 | 1376.5 | 881 |
| | | 2.72 | | | | | | |
| .647 | 6.25 | | .444 | 25.4° | 4.045 | 24.91 | 1346.9 | 871 |
| | | 4.08 | | | | | | |
| .654 | 6.38 | | .659 | 37.8° | 4.175 | 24.03 | 1317.0 | 861 |
| | | 5.44 | | | | | | |
| .662 | 6.51 | | .870 | 49.8° | 4.31 | 23.19 | 1288.5 | 853 |
| | | 6.8 | | | | | | |
| .665 | 6.69 | | 1.076 | 61.6° | 4.45 | 22.23 | 1255.8 | 835 |
| | | 8.16 | | | | | | |
| .673 | 6.82 | | 1.277 | 73.2° | 4.59 | 21.32 | 1224.9 | 824 |
| | | 9.52 | | | | | | |
| .680 | 6.956 | | 1.475 | 84.5° | 4.73 | 20.40 | 1193.6 | 812 |
| | | 10.88 | | | | | | |
| .687 | 7.10 | | 1.668 | 95.6° | 4.88 | 19.47 | 1162.0 | 798 |
| | | 12.24 | | | | | | |
| .695 | 7.24 | | 1.858 | 106.5° | 5.035 | 18.53 | 1130.0 | 785 |
| | | 13.6 | | | | | | |
| .706 | 7.36 | | 2.044 | 117.1° | 5.195 | 17.58 | 1097.7 | 775 |
| | | 14.96 | | | | | | |
| .717 | 7.476 | | 2.228 | 127.7° | 5.36 | 16.61 | 1064.7 | 763 |
| | | 16.32 | | | | | | |
| .732 | 7.54 | | 2.409 | 138.0° | 5.52 | 15.62 | 1031.1 | 755 |
| | | 17.68 | | | | | | |
| .746 | 7.61 | | 2.588 | 148.3° | 5.68 | 14.62 | 997.1 | 744 |
| | | 19.04 | | | | | | |
| .761 | 7.674 | | 2.766 | 158.5° | 5.84 | 13.60 | 962.4 | 732 |
| | | 20.4 | | | | | | |
| .776 | 7.732 | | 2.943 | 168.6° | 6.00 | 12.55 | 926.7 | 719 |
| | | 21.76 | | | | | | |
| .790 | 7.797 | | 3.118 | 178.6° | 6.16 | 11.48 | 890.3 | 703 |
| | | 23.12 | | | | | | |
| .809 | 7.812 | | 3.292 | 188.6° | 6.32 | 10.40 | 853.6 | 691 |
| | | 24.48 | | | | | | |
| .838 | 7.733 | | 3.467 | 198.6° | 6.48 | 9.28 | 815.5 | 683 |
| | | 25.84 | | | | | | |
| .868 | 7.65 | | 3.644 | 208.8° | 6.64 | 8.12 | 776.1 | 674 |
| | | 27.2 | | | | | | |
| .897 | 7.60 | | 3.822 | 219.0° | 6.82 | 6.92 | 735.3 | 660 |
| | | 28.56 | | | | | | |
| .934 | 7.544 | | 4.002 | 229.3° | 7.046 | 5.67 | 692.8 | 647 |
| | | 29.92 | | | | | | |
| .978 | 7.44 | | 4.184 | 239.7° | 7.275 | 4.37 | 648.6 | 634 |
| | | 31.28 | | | | | | |
| 1.037 | 7.242 | | 4.369 | 250.3° | 7.51 | 3.00 | 602.0 | 624 |
| | | 32.64 | | | | | | |
| 1.103 | 7.026 | | 4.559 | 261.2° | 7.75 | 1.55 | 552.7 | 610 |
| | | 34.00 | | | | | | |
| 1.18 | 6.805 | | 4.756 | 272.5° | 8.00 | 0 | 500 | 590 |

-continued

| Ratio TF Arm to Driven Arm | "RF" Arm Length (cm) | Travel of Push Plate 40 (cm) | Total Device Rotation Radians/Degrees | "TF" Arm Length (cm) | Spring Extension (working range) (cm) | "TF" at Given Extension (grams force) | "RF" Force (grams force) |
|---|---|---|---|---|---|---|---|
| Empty Canister | | | | | | | |

*with allowance to compensate for friction of currency on supporting surface.

Table 1 sets forth the respective dimensions of the moment arms between axis A and tension force TF and resultant force RF for cam portions 108, 110 at various positions of rotation of unit 90 from its initial position. Table 1 shows that as force modifying unit 90 rotates from its initial position shown in FIG. 2, the moment arm of tension force TF continuously increases (to compensate for the decreasing tension force TF in spring 94) and the moment arm of resultant force RF increases slightly, then decreases. Table 1 also illustrates the force degradation in tension spring 94, i.e. from 1,400 grams to 500 grams as the tension spring contracts, and shows the resultant force RF as modified by modifying unit 90, i.e. from 890 grams to 590 grams. Thus, whereas the tension force TF generated by spring 94 over its "working range" has a net change of 900 grams between its fully extended position and its contracted position, the output force on the push plate varies by only 300 grams between the fully loaded position and the fully empty position. The present invention thus provides a force modifying unit which substantially reduces the force degradation in the illustrated spring biasing system and produces a more uniform biasing force on the push plate.

The invention has been described with respect to a preferred embodiment. Modifications may occur to others skilled in the art upon their reading and understanding of the specification. It is intended that all such modifications ad alterations be included in so far as they come within the scope of the invention as claimed or the equivalent thereof.

Having thus described the invention, the following is claimed:

1. An elongated, generally rectangular currency canister for moving a stack of sheet currency toward a dispensing position at one end thereof where individual sheets are dispensed, said canister having a first lengthwise compartment for holding said stack of currency, a second lengthwise compartment, and a device for biasing said stack in the direction of said dispensing position, said biasing means comprising:

plate means disposed within said first and second compartments movable along a predetermined plate path between a first position remote from said dispensing opening and a second position adjacent said dispensing opening for pushing said stack in said first compartment toward said dispensing position, plate cable means having a first end and second end, said first end being connected to said plate means in said second compartment, a tension spring disposed in said second compartment having a stationary end fixed relative to said dispensing position and a free end movable along a predetermined spring path within said second compartment between a first position wherein said spring is extended a predetermined distance and a second contracted position, said spring defining a tension force having a predetermined value when in said first position which diminishes as said spring retracts along said spring path toward said second position, spring cable means having a first and a second end, said first end being connected to said free end of said tension spring, and a force modifying member disposed in said second compartment for transmitting said tension force in said spring to said plate means to move said plate means along said plate path, said modifying member being rotatable through at least 270 degrees about an axis fixed relative to said dispensing opening from a first rotation position corresponding to said first spring position and second rotation position corresponding to said second spring position and having first and second outwardly facing noncircular arcuate surfaces to receive said tension spring cable means and said plate cable means respectively, said first arcuate surface being generally helical in shape and spiraling outwardly, said second ends of said cable means being attached to said modifying member wherein said spring cable means is disposed on said first surface when said spring is in said first position, said tension force biasing said modifying member to rotate in a predetermined direction wherein said plate cable means is wound onto said second arcuate surface and said spring cable means is unwound from said first arcuate surface and said rotation of said member producing a resultant force on said plate means via said plate cable means to force said plate means toward said dispensing position, said first and second surfaces being dimensioned to vary the respective distances between said spring cable means and said plate cable means and said axis as said modifying member rotates, the ratio of the distance between said spring cable and said axis relative to the distance between said plate cable and said axis continually increasing as said modifying member rotates from said first position to said second position.

2. A biasing device as defined in claim 1 wherein such distance between said spring cable means and said axis increases as said force modifying member rotates in said predetermined direction.

3. A biasing device as defined in claim 1 wherein said spring cable means and said plate cable means are wire cables.

4. A biasing device as defined in claim 1 wherein said spring cable means and said plate cable means are timing chains.

* * * * *